US009346152B2

(12) United States Patent
Green et al.

(10) Patent No.: US 9,346,152 B2
(45) Date of Patent: May 24, 2016

(54) FURNITURE ASSEMBLY JIG

(71) Applicant: Ashley Furniture Industries, Inc., Arcadia, WI (US)

(72) Inventors: Jeffery C. Green, Ripley, MS (US); Christopher Jon Lejcher, Blair, WI (US); Timothy A. Brandtner, Ettrick, WI (US)

(73) Assignee: ASHLEY FURNITURE INDUSTRIES, INC., Arcadia, WI (US)

( * ) Notice: Subject to any disclaimer, the term of this patent is extended or adjusted under 35 U.S.C. 154(b) by 491 days.

(21) Appl. No.: 13/741,309

(22) Filed: Jan. 14, 2013

(65) Prior Publication Data

US 2014/0026389 A1 Jan. 30, 2014

Related U.S. Application Data

(60) Provisional application No. 61/586,689, filed on Jan. 13, 2012, provisional application No. 61/591,829, filed on Jan. 27, 2012.

(51) Int. Cl.

| | |
|---|---|
| ***B25B 11/02*** | (2006.01) |
| ***B25H 1/10*** | (2006.01) |
| ***B25H 1/14*** | (2006.01) |

(52) U.S. Cl.

CPC *B25B 11/02* (2013.01); *B25H 1/10* (2013.01); *B25H 1/14* (2013.01); *Y10T 29/49863* (2015.01); *Y10T 29/53961* (2015.01)

(58) Field of Classification Search

CPC ..... B23P 19/04; B23P 19/048; B23P 19/10; B23P 19/00

See application file for complete search history.

(56) References Cited

U.S. PATENT DOCUMENTS

| | | | |
|---|---|---|---|
| 3,717,375 | A | 2/1973 | Slobodan |
| 4,339,488 | A | 7/1982 | Brokmann |
| 5,154,398 | A | 10/1992 | Mayfield |
| 5,794,911 | A | 8/1998 | Hill |

(Continued)

FOREIGN PATENT DOCUMENTS

| | | | |
|---|---|---|---|
| CN | 2334259 | Y | 8/1999 |
| CN | 201001529 | Y | 1/2008 |

(Continued)

*Primary Examiner* — Lee D Wilson

(74) *Attorney, Agent, or Firm* — Christensen Fonder P.A.

(57) ABSTRACT

A furniture jig comprises a frame member positioning portion and a spring stretcher portion with at least the positioning frame portion having a rotating feature. The positioning frame portion may surround the spring stretcher portion and comprises constraint members that define receiving regions, such as slots or channels, into which furniture components, such a box frame members, may be inserted. The receiving regions of the jig frame maintain the furniture components upright or in other useful orientations at least until they are affixed together. In embodiments, the spring stretcher has a plurality of spring receiving portions on which the ends of a spring can be releasably engaged. Support members extending from the spring receiving portions operate to move the spring receiving portions from a spring loading position in which the springs can positioned on the tips to a spring attachment position where the springs are securable to the frame members. Drive portions, such as pneumatic or hydraulic cylinders move the spring receiving portions and support members between the respective positions. A control processor can automate the motions and be activated by a pedal or other switch.

15 Claims, 14 Drawing Sheets

(56) References Cited

U.S. PATENT DOCUMENTS

| | | | | |
|---|---|---|---|---|
| 5,839,181 | A * | 11/1998 | Chu | B25B 11/02 29/281.5 |
| 5,870,809 | A * | 2/1999 | Nishi | B62K 5/01 29/281.3 |
| 6,565,157 | B2 | 5/2003 | Barile, Jr. et al. | |
| 7,913,986 | B2 * | 3/2011 | Fredrickson | B23Q 3/102 269/37 |
| 7,926,797 | B2 * | 4/2011 | Sorenson | G02B 6/4475 269/138 |
| 8,104,121 | B2 | 1/2012 | Bourgraf et al. | |
| 2003/0052526 | A1 | 3/2003 | Crosby et al. | |
| 2009/0102269 | A1 | 4/2009 | Dotta et al. | |
| 2014/0026389 | A1 * | 1/2014 | Green | B25H 1/10 29/446 |

FOREIGN PATENT DOCUMENTS

| | | | |
|---|---|---|---|
| CN | 101394822 | A | 3/2009 |
| CN | 201290499 | Y | 8/2009 |

* cited by examiner

FURNITURE ASSEMBLY JIG

RELATED APPLICATION

The present application claims the benefit of U.S. Provisional Application No. 61/586,689, entitled FURNITURE ASSEMBLY JIG and filed Jan. 13, 2012, and U.S. Provisional Application No. 61/591,829, entitled SEAT WITH ELASTOMERIC SUSPENSION WEBBING AND METHODS OF MANUFACTURE and filed Jan. 27, 2012, which are incorporated herein in its entirety.

FIELD OF THE INVENTION

The present invention is generally directed to a furniture assembly jig for positioning furniture components for attachment of fasteners and other components in the assembly of a furniture item. Specifically, the present invention is directed to a furniture jig for tensioning and positioning springs or an elastomeric suspension webbing on frame components for securing the springs to the frame components in the assembly of a furniture item having a flexible seating surface.

BACKGROUND OF THE INVENTION

A conventional chair or sofa typically comprises a rectangular frame or "seat box" having a having at least one cushion supported over a plurality of elongated springs stretched between the sides of the seat box. Another common configuration, particularly in sofas, is stretching a downwardly deflectable wire webbing between the sides of the seat box. The wire webbing frequently comprises interlinked wire, coiled springs or s-shaped springs, collectively referred to as the "seat springs." The springs are typically stretched across the frame of the seat box to provide a flexible, yet supportive seating surface in which the seat springs stretch axially in response to weight applied transversely from a sitting individual being such that the seating surface flexes downward to provide a contoured and more comfortable seat. The springs are typically mounted to the frame such that the springs initially under tension maintaining at level surface until a person sits on the seat cushions. The pre-tensioned springs also bias the seat surface back to a level surface after a seated person stands up. The frame is often assembled prior to the springs being attached to provide the structural support for tensioning the springs. The inherent drawback of pre-assembling the frame is that the large frames used for sofas and other seating furniture can be difficult to maneuver and position for attachment of the springs making assembly tedious and labor intensive.

The springs stretch to provide a contoured seating surface for individuals seated on the sofa until the downward weight of the seated person equalizes with the force required to continue stretching the springs, thereby stopping the downward decent of the seated person. In order to accommodate the weight of a wide range of possible weights, including people weighing several hundred pounds, without breaking, the springs typically have high tensile strength requiring substantial axial force to stretch. The significant tensile strength required to tension the springs individually can be labor intensive requiring repeated application of significant physical exertion to stretch and attach each spring. In addition, the strength required to stretch all the springs at once is often too much for single individual requiring the springs to be attached individually or in small groups. An obvious manufacturing concern is always minimizing the amount of labor and time of construction in manufacturing furniture. In the arena of mass marketed furniture, the improving assembly time by even a minimal amount can result in cost savings. The tedious and tiring process of stretching and attaching the springs can create a substantial bottleneck in the manufacturing process, particular as workers continue to tire from manually stretching the springs.

Known spring stretchers can reduce fatigue in the assembler, but can be equally if not more time consuming than manually assembling the springs. Although handheld mechanical springs stretchers can make stretching and maintaining the springs in the stretched position easier, affixing the springs to the seat box while attached the handheld stretcher and then removing the stretcher can be even more tedious and time consuming.

The inherent manufacturing challenge of tensioning and installing high tensile springs on the seat box of a furniture item creates a need for a means of efficiently attaching tensile springs in furniture assembly.

SUMMARY OF THE INVENTION

The present invention is directed to a furniture jig for assembling the components of a furniture item including assembly of a seat box frame and stretching springs or an elastomeric webbing between the components of the seat box frame. The webbing can comprise a network of interconnected elastomeric strands that can be elongated when a weight is placed on the webbing and return to their original length when the weight is removed. In an embodiment of the present invention, the furniture jig generally comprises, a furniture frame positioning portion and a spring stretcher. The furniture frame positioning portion defines a plurality of receiving regions, such as slots or channels, for receiving frame components for the seat box. The receiving regions are positioned around the spring stretcher portion such that the frame components are arranged in a generally rectangular configuration around the spring stretcher portion when the frame components are inserted into the receiving regions. In certain embodiments, the receiving regions are shaped to maintain the furniture components upright or in other useful orientations at least until the components are affixed to each other. The spring stretcher portion comprises at least one pair of arms each having a tip with a spring receiving portion to which an end of a spring or a loop of the webbing section can be releasably engaged. The pair of arms can be moved by a positioning assembly including drive portions, such that the spring receiving portions are moved apart to axially stretch the spring or webbing section. In certain embodiments, the arms can be oriented such that the movement of the spring receiving portions to tension the spring or webbing section, positions the ends of the spring into engagement or proximate the corresponding frame members when the spring is properly tensioned for easy engagement of the spring to the seat box.

In certain embodiments, an elastomeric webbing can be attached with the furniture jig instead of a metal spring. The elastomeric material may be less likely to be deformed or damaged than metal coil springs thereby preventing sagging and reducing the likelihood of product returns. Different elastomers can be used to vary the resilience of the receiving surface according to the intended use of the furniture item. In one aspect, the network can comprise more than one layer of interconnected elastomeric strands, each layer having the same or different resiliencies to customize the resilience of the seat cushion receiving surface.

In an aspect of the present invention, the density or thickness of strands can be varied across the network such that the resilience of the receiving surface varies across the surface. In one aspect, the density or thickness of strands can be greater along the edges of the receiving surface than in the center of the receiving surface. In this configuration, the center can more easily deform, while the edges are more rigid thereby providing a receiving surface that is both comfortable and supportive. In particular, the more rigid edges are particularly advantageous at the arm rests which will typically not have lateral connection to the frame.

In another aspect, the strands of the network can be arranged into a plurality of interlocking diamonds. In this configuration, the interior strands of the network each define a shared strand between two diamonds. Each diamond can define a first diagonal and a second diagonal, wherein the first diagonal is transverse to the second diagonal. The first diagonal can also be greater in length than the second diagonal. In one aspect, the network can be oriented such that the first and second diagonals are transverse to the edges of the seat box.

In an embodiment of the present invention, the furniture jig can further comprise a rotatable mount for rotation of the jig frame and the spring stretcher portion allowing operators to quickly reposition the furniture item during assembly for efficient insertion of the seat box frame components as well as fasteners for securing the frame components and the springs. In certain embodiments, the rotatable mount can further comprise an elevating assembly for moving the jig frame vertically relative to the spring stretcher portion to position the seat box into engagement with the ends of the spring for fixation of the spring to the seat box frame.

A furniture jig, according to an embodiment of the present invention comprises a jig frame and included within or part of the jig frame, a furniture frame positioning portion, a spring stretcher portion, and a rotatable mount. The jig frame can further comprise a plurality of frame members each defining a slot for receiving a component of the seat box, wherein the frame members are arranged in a generally rectangular orientation. The spring stretcher portion further comprises a positioning assembly with powered portions and at least one pair of arms movable by the positioning assembly between a first orientation and a second orientation. Each arm can comprise a curved shape with a tip having a spring receiving portion, wherein the pair of arms is arranged in a mirrored orientation such that the tips having spring receiving portions are pointed in opposing directions. In certain embodiments, the positioning portion is adapted to rotate the arms between a first position and a second position, wherein the tips are moved apart horizontally as the arms are rotated into the second position. In this configuration, the rotation of the arms also lowers the tips vertically such that the spring receiving portions are positioned proximate to the slots of the frame members. In certain embodiments, the positioning assembly is adapted to move the arms horizontally between a first position and a second position to increase the horizontal distance between the spring receiving portions of the corresponding arms. In this configuration, the positioning assembly can be adapted to raise the jig frame to position the spring receiving portions are positioned proximate to the slots of the frame members. In certain embodiments, the positioning assembly is adapted to move the arms in a complex curve between a first position and a second position to increase the horizontal distance between the spring receiving portions of the corresponding arms and for attachment to the furniture frame components.

In operation, the first position corresponds to a first horizontal distance between the spring receiving portions that approximates the length of a standard spring at rest or slightly compressed. In the first position, the ends of the spring receiving portions can be operably engaged to the spring receiving portions without tensioning the spring or webbing. The second position corresponds to a second horizontal distance between the spring receiving portions that approximates the length of the spring at the appropriate tension, wherein the second distance is greater than the first distance. Similarly, the spring holding portions position the ends of the spring proximate to the furniture components inserted into the slots of the frame members for engagement to the components when the arms are positioned in the second position. In one aspect, the furniture components can each be pre-fitted with at least one engagement member for engaging the ends of the spring or loops of the webbing.

In an embodiment of the present invention, the furniture jig can further comprise an elevating assembly for elevating the jig frame independently of the spring stretcher portion to move furniture components independently of a spring positioned on each pair of arms. In this configuration, the spring stretcher portion can initially stretch the spring by positioning the arms into the second position before the jig frame is lifted by the elevating assembly such that the furniture components retained on the jig frame proximate with the ends of the spring for engagement of the springs to the furniture component.

A furniture item, in one aspect of the present invention, can comprise a seat box having a rectangular frame and at least one suspension webbing section. The rectangular frame can comprise at least two opposing walls defining the sides of the frame and two opposing end walls defining the ends of the frame. Each opposing wall can comprise a plurality of engagement features spaced along the length of the wall for engaging and affixing the edges of the webbing to the opposing walls. The opposing walls are spaced such that engaging the edges of the webbing to the opposing walls tensions the webbing. In this configuration, the webbing defines a planer receiving surface over the seat box. In one aspect, the engagement features can define hooks insertable into the diamonds positioned along the periphery of the network to secure the webbing to the opposing walls. In another aspect, the seat box can comprise at least one seat stretcher extending between the opposing walls for preventing bowing of the opposing walls due to the stretched webbing.

A furniture jig for assembling a furniture item, according to an aspect of the present invention, comprises a first frame vise, a second frame vise and a positioning assembly. The first frame vise defines a first slot for receiving and positioning one of the opposing walls. Similarly, the second frame vise defines a second slot for receiving and positioning the other opposing walls. The positioning assembly is adapted to move the first and second frame vises between a first position in which the frame vises are separated by a first distance and a second position in which the frame vises are separated by a second distance. In operation, the edges of each webbing section are affixed to the opposing walls when the frame vises are positioned in the first position. The when the frame vises are separated by the first distance, the webbing can be affixed to the opposing walls without significantly tensioning the webbing. Once the webbing is affixed to the opposing walls, the frame vises are pulled apart until separated by a second distance to tension the spring. The end walls can then be affixed to the opposing walls to fix the opposing walls and maintain the tension on the spring.

A method of assembling furniture according to an embodiment of the present invention, comprises providing the furniture jig having the jig frame and spring stretcher portion mounted on a rotatable mount, wherein the jig frame comprises a plurality of frame members each defining a channel for receiving a furniture component, wherein the spring stretcher portion comprises a pair of arms each having a tip. The method also comprises inserting a furniture component into each of the channels, wherein the channels are arranged in a generally rectangular configuration around the spring stretcher. In one aspect, the method can comprise fastening furniture components retained by the jig frame to each other with fasteners. The method further comprises positioning the arms of the spring stretcher portion in the first position with the positioning assembly such that the ends of the arms are positioned a first horizontal distance and engaging the tips of the arms with the ends with a spring or loops of a webbing such that the spring or webbing extends between the tips. The method further comprises stretching the spring or webbing by moving arms into the second position in which the tips are separated by a second horizontal distance greater than the first horizontal distance, wherein the ends of the spring or webbing are positioned proximate to the components positioned in the primary channels. Finally, the method can comprise elevating the jig frame to engage the components to the ends of the spring or webbing.

A method of assembling a furniture item having an elastomer spring suspension, according to an aspect of the present invention, comprises providing a furniture jig having a first frame vise defining a first slot, a second frame vise defining a second slot and a positioning assembly. The method further comprises positioning a first opposing wall having a first plurality of engagement features into the first slot and positioning a second opposing wall having a second plurality of engagement features into the second slot. The method also comprises positioning the first and second frame vises with the positioning assembly such that the first and second opposing walls are a first distance apart. The method further comprises engaging the edges of at least one webbing section to the first and second plurality of engagement features such that the webbing is suspended between the first and second walls. The method also comprises tensioning the webbing by moving the first and second frame vises apart with positioning assembly such that the first and second opposing walls are separated by a second distance, wherein the second distance is greater than the first distance. Finally, the method comprises positioning at least one end wall between the opposing walls to maintain the separation between the opposing walls and tension on the spring.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which:

FIG. 37 is a representative view of an example of the motion of an arm attaching the elastomeric webbing of FIGS. 34-36 and then moving away there from.

Figure 1:
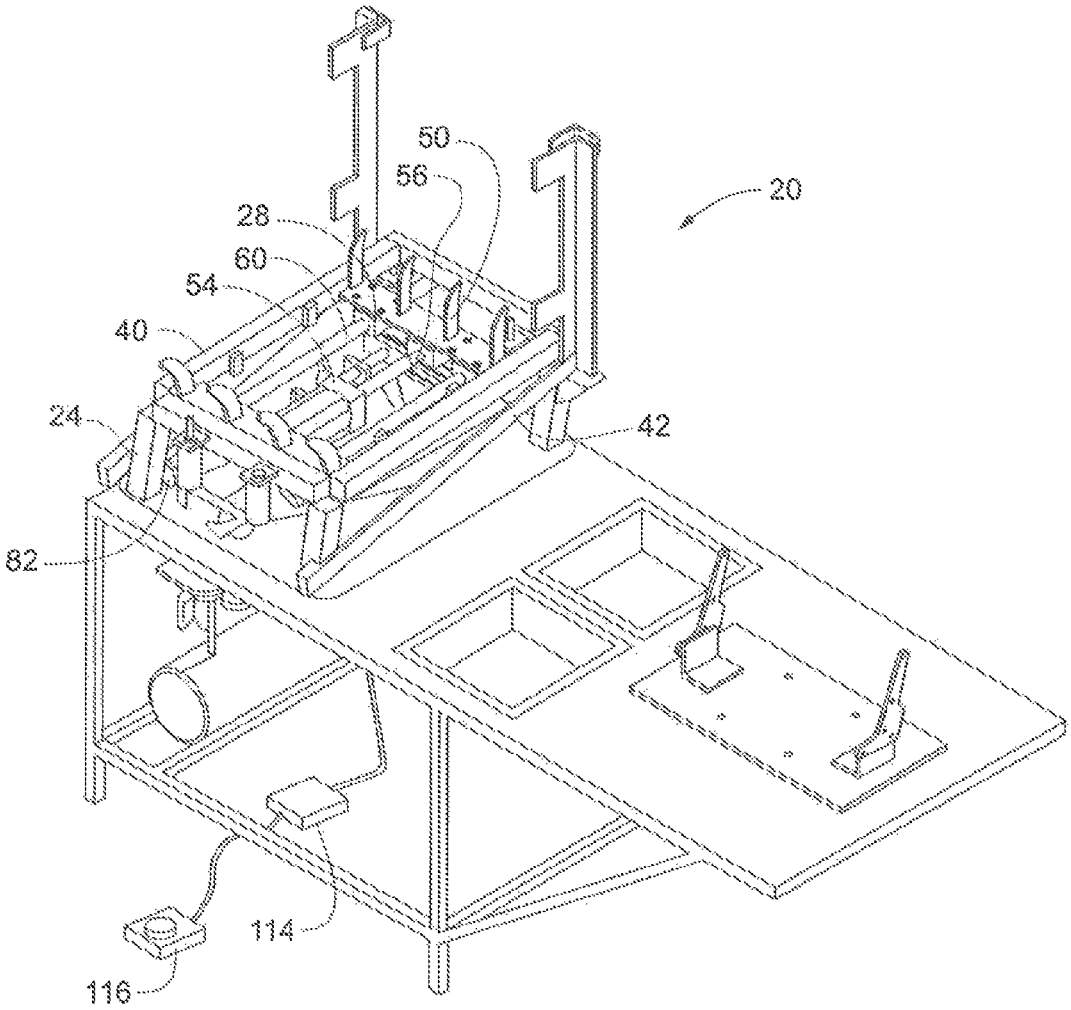
FIG. 1 is a perspective view of the furniture assembly jig according to an embodiment of the invention.
Figure 2:
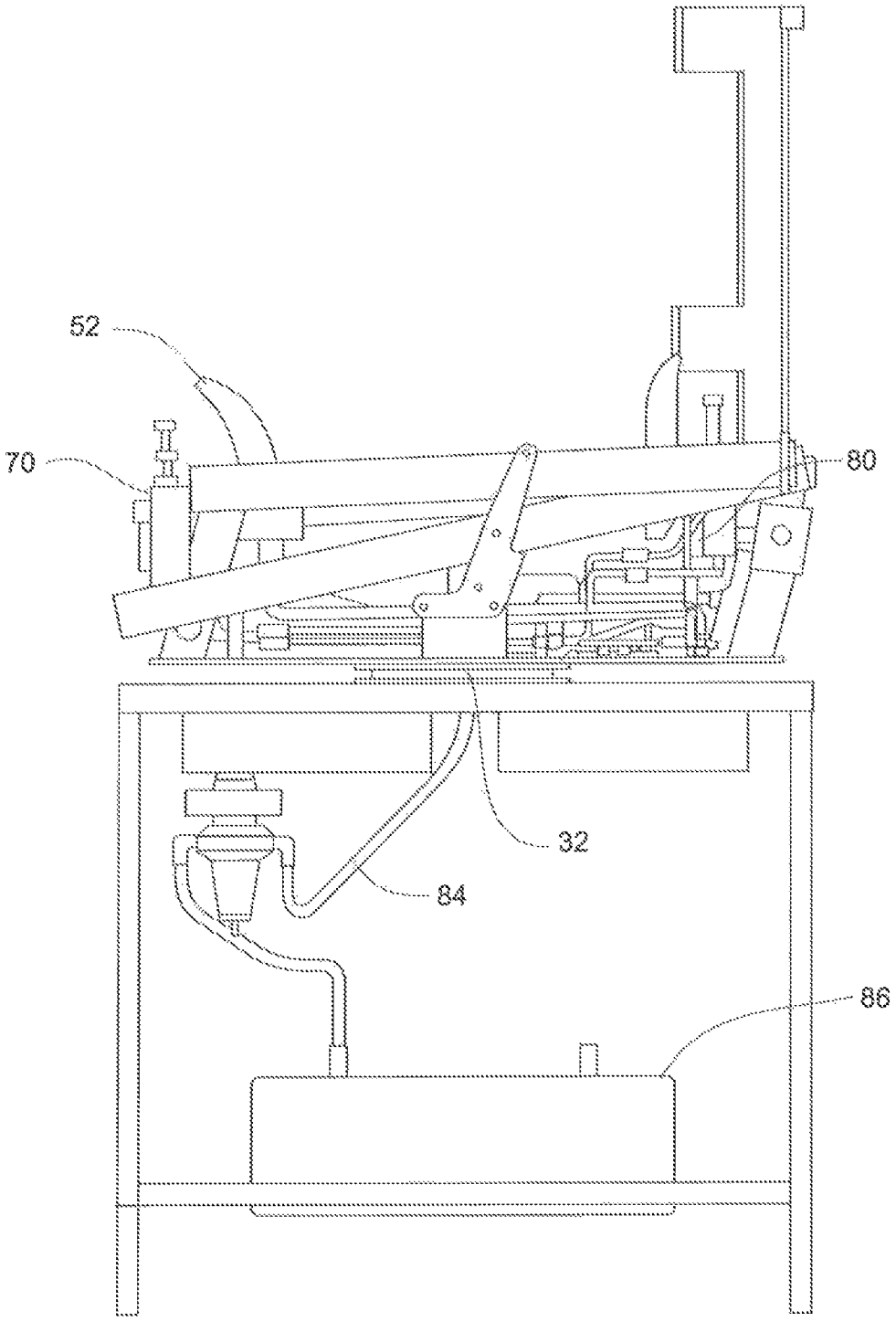
FIG. 2 is a side elevational view of the furniture assembly jig according to an embodiment of the invention.
Figure 3:
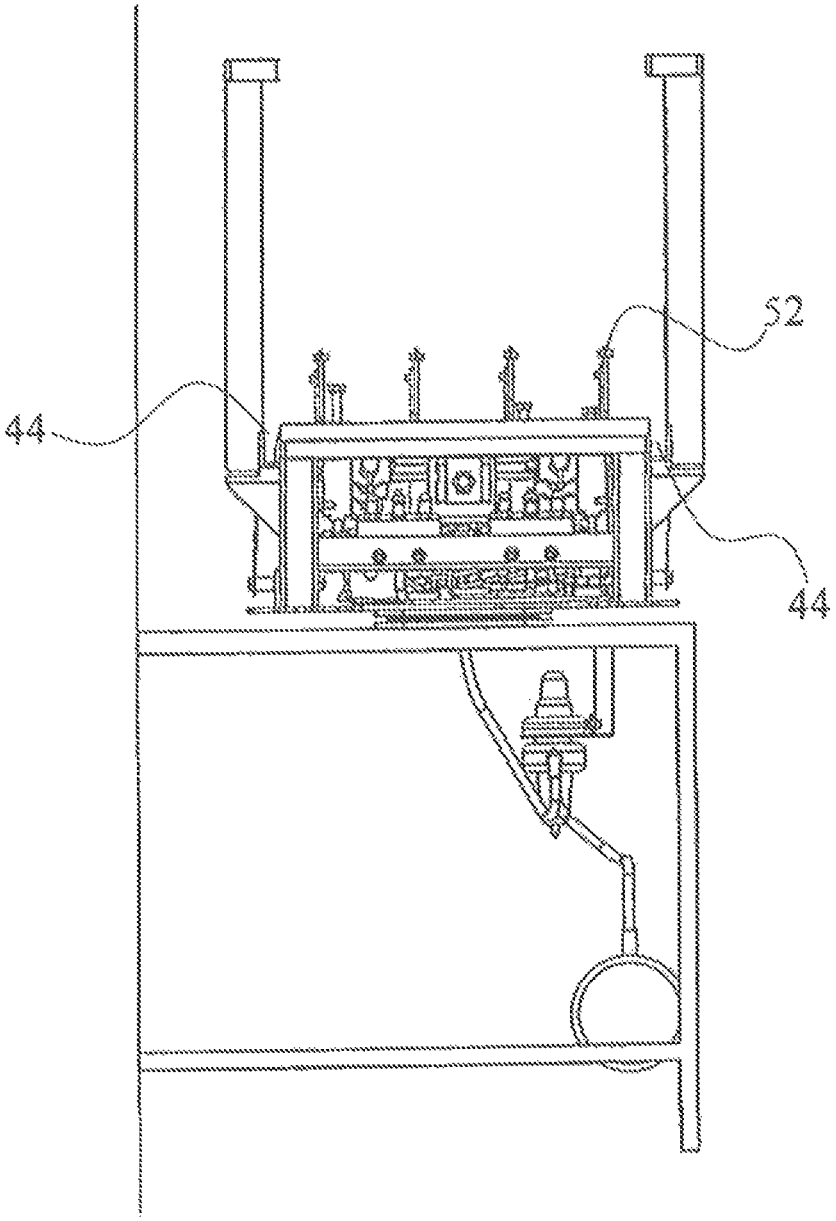
FIG. 3 is a side elevational view of the furniture assembly jig according to an embodiment of the invention.
Figure 4:
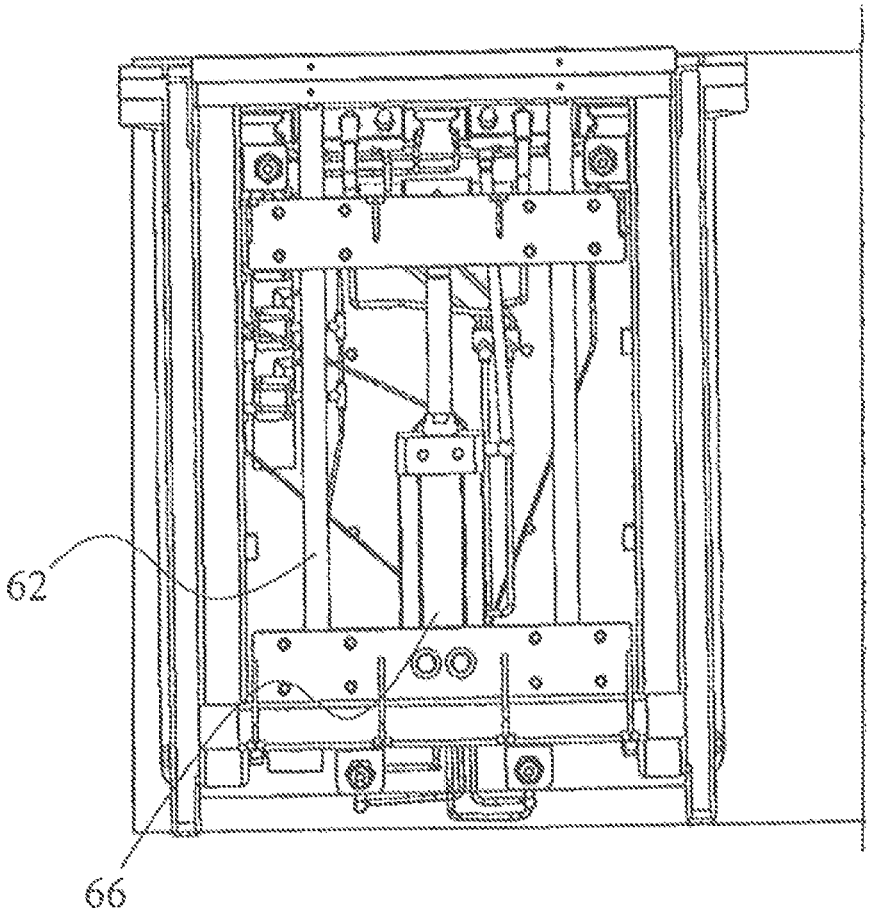
FIG. 4 is a side elevational view of the furniture assembly jig according to an embodiment of the invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

As depicted in FIGS. 1-6, a furniture assembly jig 20, according to an embodiment of the present invention, comprises a jig frame 24, a furniture frame member positioning portion 25 and a spring stretcher portion 28. Generally, the jig frame 24 is adapted to receive and position a plurality of frame components for a seat box. The jig frame 24 can position the frame components at the proper spacing and orientation for receiving fasteners to assemble the seat box or attaching other furniture components for the furniture item. Similarly, the spring stretcher portion 28 is adapted to receive at least one axially stretchable spring and apply an axial force to the spring to stretch the string to a predetermined tension. The spring can comprise coiled springs, s-shaped springs, interconnected spring webbing and other conventional springs or elastic structures that are attached to furniture seat boxes for providing a flexible seating surface. The spring stretcher portion 28 also positions the springs after stretching such that the ends of the spring are positioned proximate to the frame components of the seat box for receiving fasteners or engagement with fasteners secured to the frame components to attach the springs to the seat box. As depicted in FIGS. 20-23, the furniture jig 20 can be used to attach a webbing 206 comprising at least one webbing section 216 each comprising a network of interconnected elastomeric strands 218. In one aspect, the strands 218 can be arranged in a cross-webbing configuration extending between the opposing walls 210. In this configuration, the strands 218 form a plurality of diamonds that expand or contract to provide a spring force.

As shown in FIGS. 20-23, in one aspect, each webbing section 216 can comprise an edge strand 220 that is thicker than the internal strands 218. The thicker edge strand 220 provides additional support along the edges of the webbing section 216. As depicted, the edge strand 220 can be positioned along the unattached edges the webbing section 216 perpendicular to the opposing walls 210. In one aspect, the strands 218 can be arranged such that the density of strands 218 increases near the edges of each webbing section 216. As shown in FIGS. 20-23, the density of strands 218 can be increased by making the diamonds formed by the strands 218 smaller and increasing the strands 218 in that area.

The webbing 206 can be formed from injection molding of various commercial quality thermoplastic elastomers such as, but not limited to styrene block copolymers, polyolefin blends, elastomeric alloys, thermoplastic polyurethanes, thermoplastic copolyester and thermoplastic polyamides.

As depicted in FIGS. 1-6, the jig frame 24 can comprise a furniture frame positioning portion 25 that comprises a plurality of frame members 40 arranged in a rectangular configuration such that the jig frame 24 has a rectangular footprint. In certain embodiments, the frame members 40 can comprise a tubular shape. Certain constraint members 40 defines receiving regions 42 configured as slots or channels 44 for receiving furniture frame components. In the rectangular configuration, receiving regions 42 are arranged to correspond to the sides of the seat box to be assembled. In operation, the appropriate furniture frame components can be inserted into the corresponding slots or channels 44 to be positioned in the proper spacing and orientation for receiving fasteners to assemble the seat box.

Figure 5:
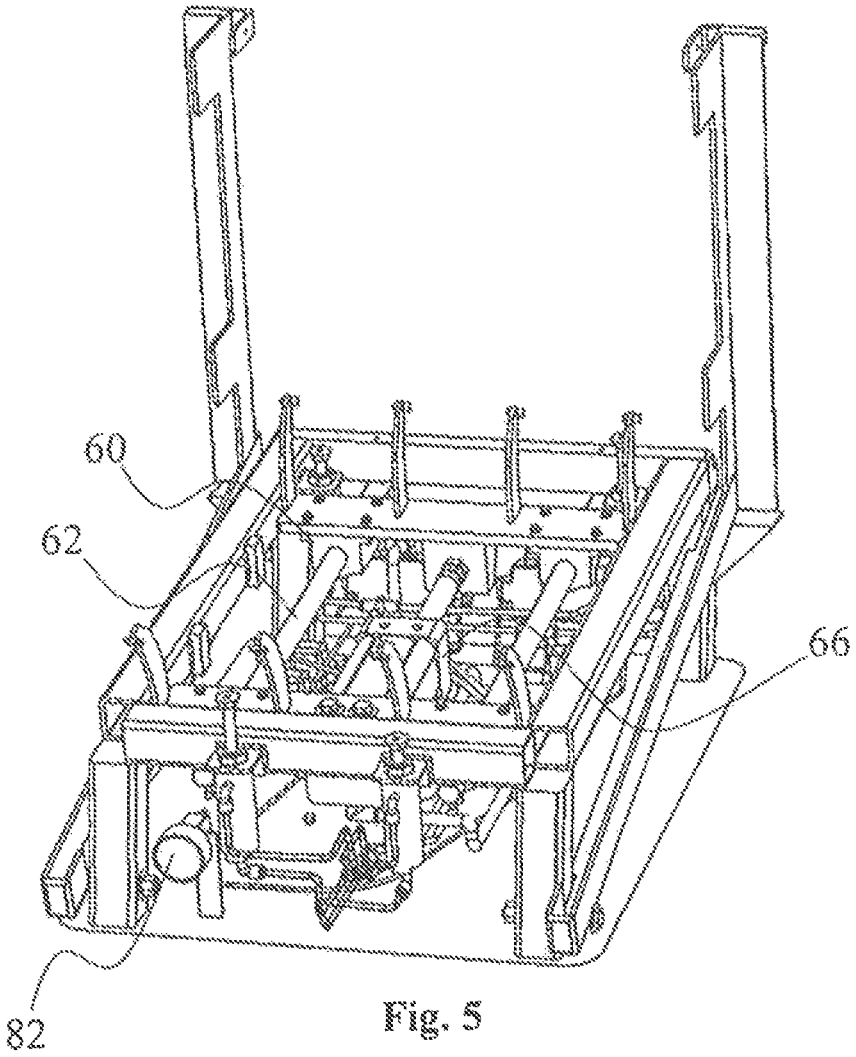
FIG. 5 is a perspective cross sectional view of the furniture assembly jig according to an embodiment of the invention with connecting lines removed for purposes of clarity.
Figure 6:
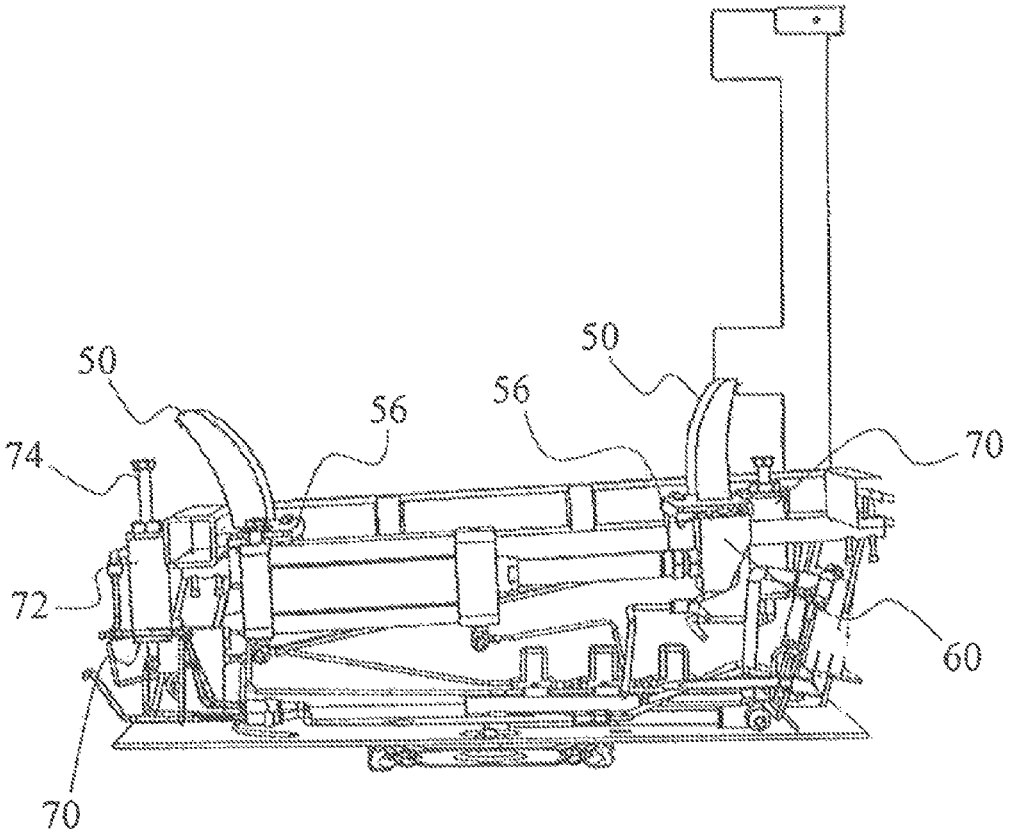
FIG. 6 is an elevational cross sectional view of the furniture assembly jig according to an embodiment of the invention with connecting lines removed for purposes of clarity.

As depicted in FIGS. 1-6, the spring stretcher portion 28 comprises at least one pair of opposing arms 50, each arm 50 defining a tip 51 comprising a spring holding portion 52. As depicted in FIGS. 5-6, in certain embodiments, the arm 50 can comprise a fin shape with a pointed tip 51 on which the spring holding portion 52 is affixed. In this configuration, the arms 50 can be arranged in a mirror configuration in which the tips 51 are oriented in opposite directions as depicted in FIGS. 5-6. The spring holding portion 52 can comprise a U-shaped bracket in certain embodiments, but can also comprise a hook shape, a notched tip 51 and other configurations capable of releasably receiving the ends of the springs. The spring stretcher portion 28 further comprises a positioning assembly 54 for moving the arms 50 between a first position in which the spring holding portions 52 are spaced apart a first horizontal distance and a second position in which the spring holding portions 52 are spaced apart at a second horizontal distance, wherein the second horizontal distance is greater than the first horizontal distance.

In one aspect, the positioning assembly 54 comprises a movable plate 56 from which at least one of the pair of arms 50 extends. In this configuration, the plate 56 comprises followers 60 that slidably engage guide bars 62 attached to the jig frame 24. A power portion configured as drive portion configured as a pneumatic cylinder 66, extends between opposing arm plates 56 and has an extension stroke and a retraction stroke. In another aspect, the positioning assembly 54 is adapted to rotate the pair of arms 50 between a first position and a second position such that the horizontal distance between the spring holding portions 52 increases from a first horizontal distance to a second horizontal distance. In this configuration, the spring holding portions 52 also move vertically such that the spring holding portions 52 are proximate to or engage at least one of the receiving regions 42. Other motions would be appropriate in particular configurations.

As depicted in FIGS. 1-6, in an embodiment of the present invention, the spring stretcher portion 28 can positioned within and attached to the jig frame 24 and a rotational mechanism 32 is attached to the jig frame 24 and to a base 34 configured as work bench. The jig frame 24 can rotate on the work bench by way of the rotatable mount 32 allowing a worker on one side of the work bench to rotate the jig frame 24 to provide ready access the furniture components therein. The rotatable mount 32 can comprise a conventional industrial style turntable bolted or screwed or otherwise attached to both the work bench and the jig frame 24.

The spring stretcher portion 28 comprises a pair of opposing arms 50 each with a spring holding portion 52. In one aspect, the arm 50 can comprise a half crescent curved shape defining a tip at one end of the arm 50 to which the spring holding portion 52 is affixed. In this configuration, the arms 50 can be arranged in a mirror configuration in which the tips are pointed in opposing directions as depicted in FIGS. 5-6. The spring holding portion 52 can comprise as a U-shaped bracket. The arms 50 are movable by a positioning assembly 54 between a first position in which spring holding portions 52 are spaced apart a first horizontal distance and a second position in which the spring holding portions 52 are spaced apart at a second horizontal distance, wherein the second horizontal distance is greater than the first horizontal distance.

In certain embodiments, the furniture assembly jig 20 further comprises an elevation assembly 70 comprising a plurality of air cylinders 72 with actuation arms 74. The air cylinders are connected to a control portion 80 including an actuation switch 82 and air lines 84, air tank 86. In this configuration, the air cylinders 72 can be extended to change the vertical position of the jig frame 24 relative to the seat stretcher 28.

A seat box for use with the present invention can comprise a plurality of frame components 46 including at least two parallel side frame components 90 and two parallel cross-frame components 94 arranged transversely side frame components 90. The side frame components 90 and the cross-frame components 94 are arranged in a rectangular configuration in which the springs are stretched between either side frame components 90 or the cross-frame components 94. The seat box can be sized to accommodate an arm chair, a sofa or other furniture with a flexible seating surface.

Figure 7:
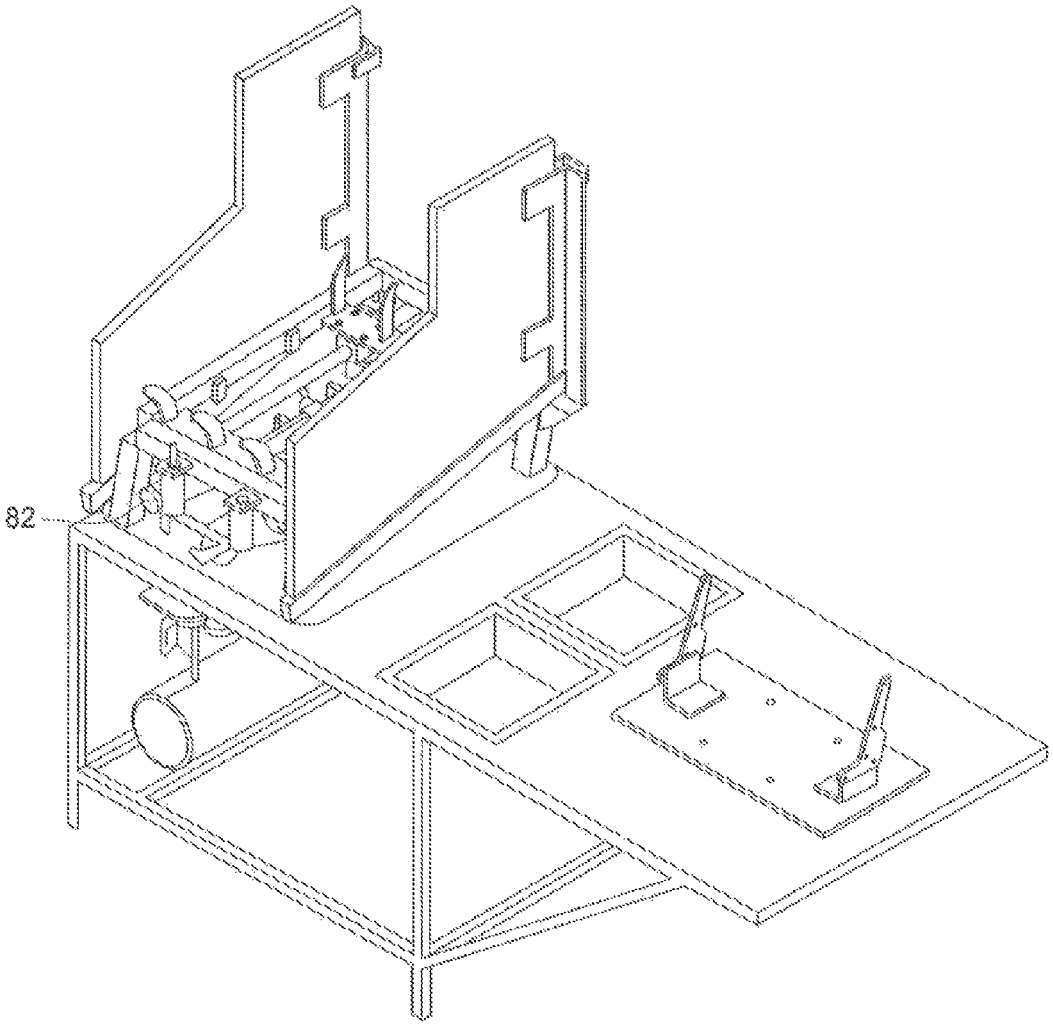
FIG. 7 is a perspective view of the jig of FIG. 1 with furniture frame components received therein.
Figure 8:
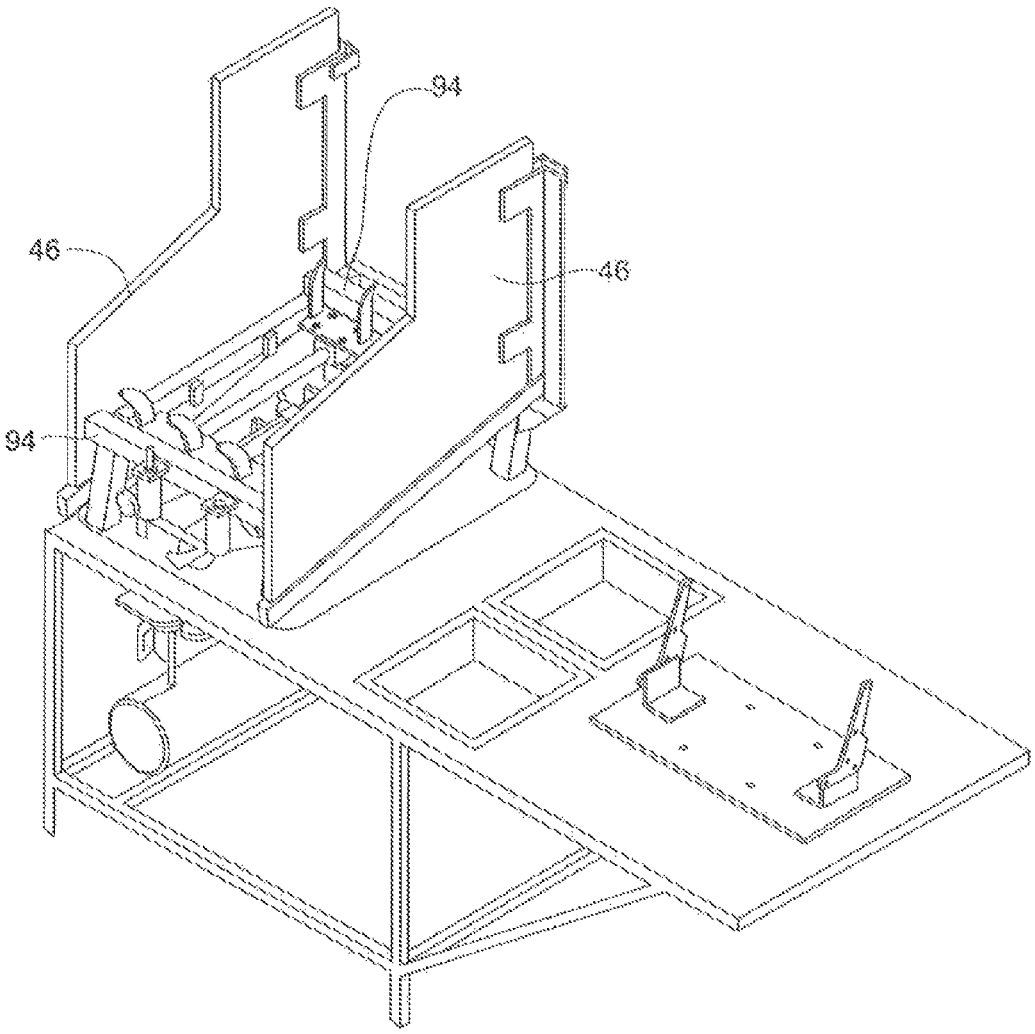
FIG. 8 is a perspective view of the jig and furniture frame components of FIG. 5 with additional furniture frame components that together form a rectangular furniture frame.
Figure 9:
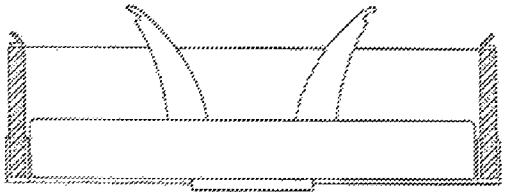
FIGS. 9 through 15 illustrate an exemplary sequence of steps for attaching springs onto a furniture frame.
Figure 16:
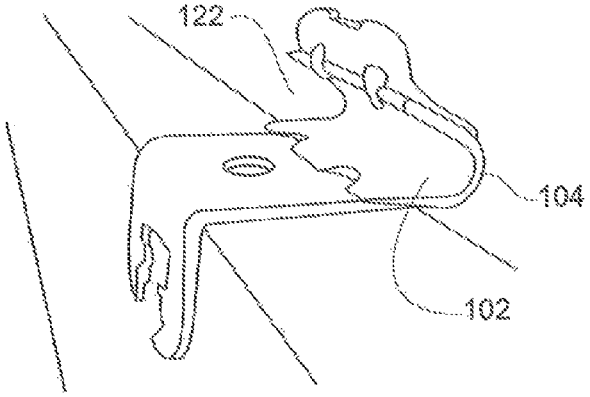
FIG. 16 is a side view of a hook clip attached to a cross frame member.
Figure 17:
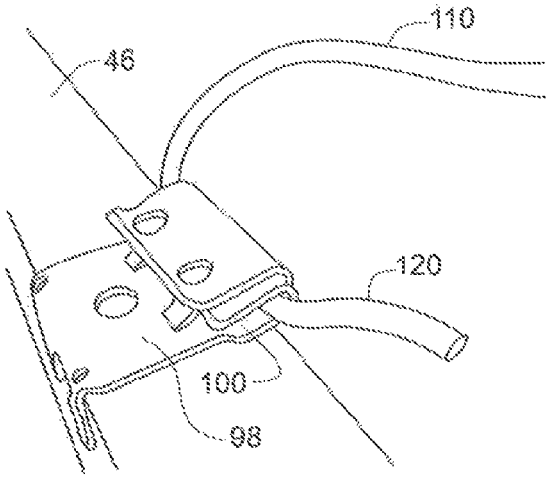
FIG. 17 is a view of the hook clip of FIG. 16 with a spring secured therein and with the hook bent down to capture the spring.

As depicted in FIGS. 3 and 7-15, in operation, furniture frame components 46, such as side frame components 90, are inserted into the receiving regions 42 of the jig frame 24. The receiving regions 42 of the jig frame 24 are arranged such that when the side frame components are arranged in a generally rectangular arrangement around the seat stretcher 28 and fixed in place when inserted into the receiving regions 42 as depicted in FIG. 7. Then cross frame members 94 can be positioned extending between the two side frame components 90 as illustrated in FIG. 8. Fasteners, such as staples or nails can comprise utilized to secure the cross frame members to the side frame members to provide a furniture frame having a rectangular footprint. As depicted in FIGS. 16 and 17, the cross members have attachment features 98. In certain embodiments, the attachment features can comprise spring clips 100 with a wire spring receiving groove 102 and a polymer cushion 104 therein. In certain embodiments, the spring clips 100 can comprise hooks inserted into the diamonds defined at the edge of the webbing section 216 to engage the webbing section 216 to the frame components 46. In other embodiments, the spring clips 100 can also comprise hooks, clamps, butterfly screws and other conventional means of affixing the springs or webbing 206 to the frame components 46.

Figure 10:
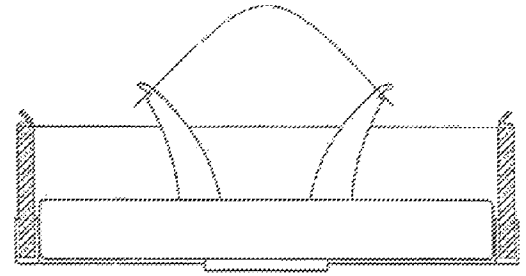
Figure 11:
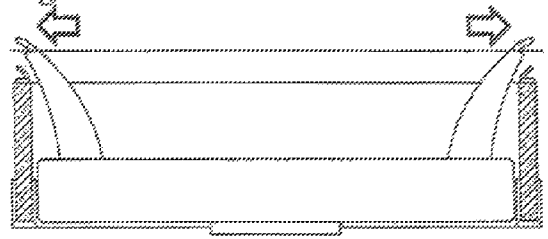
Figure 12:
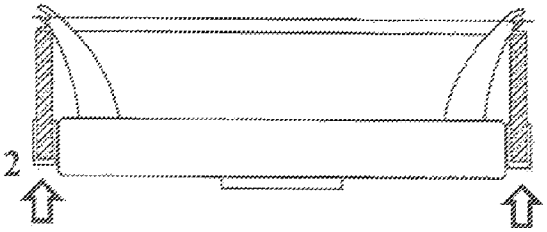
Figure 13:
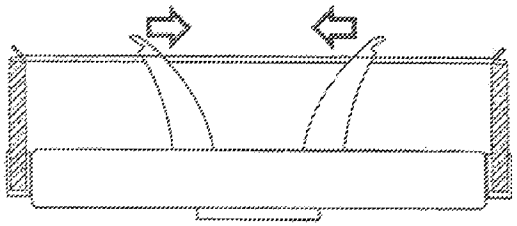
Figure 14:
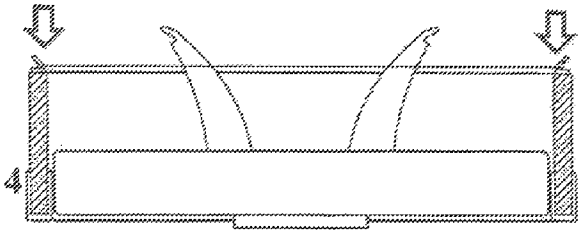
Figure 15:
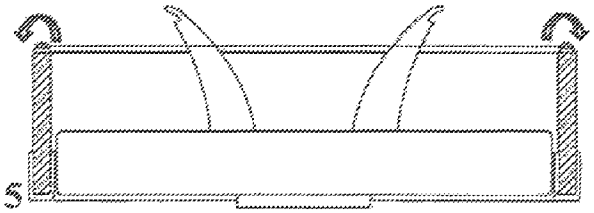
Figure 18:
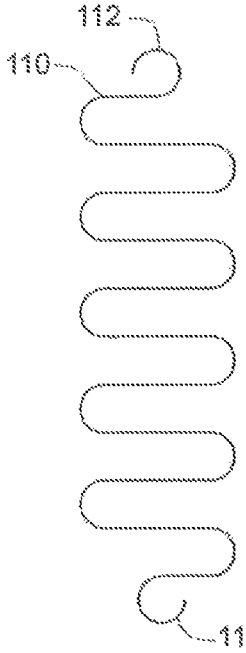
FIG. 18 is a view of a spring suitable for attachment by the jig disclosed herein.

As depicted in FIGS. 9-18, after assembly of the seat box, each pair of arms 50 are positioned by the positioning assembly 54 in the first position, wherein the first position corresponds a first horizontal distance approximating or less than the resting length of a spring 110. As depicted in FIG. 10, the springs 110 are loaded onto the spring holding portions 52 of the arms 50 such that the ends of the springs 110 are engaged, such as by hand, to the spring holding portions 52 of the arms 50. The corresponding resting length of the spring 110 and the first horizontal distance allows the spring 110 to be attached to the arms 50 in a relaxed state easing the installation of the spring 110. In certain embodiments, the springs 110 will be attached to the spring holding portion 52 at a location 112 displaced from the end of the spring 110, for example one half wave (considering the spring is essentially sinusoidal) away from the end to provide a free spring end as depicted in FIG. 18. Next, as illustrated in FIG. 11, the spring stretcher portion 28 is actuated and the positioning assembly 54 moves the arms 50 into the second position which increases the horizontal distance between the spring holding portions 52 of the corresponding pairs of arms 50, thereby stretching the springs 110 horizontally. In certain embodiments, the ends 120 of the springs 110 are then moved vertically towards the spring clips 100 by way of a vertical raising of the jig frame 24 by the elevation assembly 70. This occurs by the sequential actuation of the elevation assembly 70, specifically the air cylinders positioned under the jig frame 24 which raises the jig frame 24 a predetermined distance to position the end 120 of the spring 110 at the mouth 122 of the groove 102 of the spring clip 100 for attachment of the spring 110 to the frame component 90 as depicted in FIG. 12. Then the positioning assembly 54 sequentially retracts moving the arms 50 inwardly as depicted in FIG. 13. The spring ends 120 then enter and are retained within in the grooves 102 in the spring clips 100. The elevating assembly 70 then lowers the jig frame 24 to its original position as depicted in FIG. 14. The spring clips 100 may then be deformed, such as by hammering, to the configuration as depicted in FIG. 17 to secure the spring 110 within the grooves 102 of the spring clips 100.

In certain embodiments, the arms 50 can be rotated by the positioning assembly 54 such that the tips 51 and the spring holding portion 52 moves horizontally as well as vertically when transitioning between the first position and the second position. In this configuration, the springs 110 are stretched horizontally by the horizontal movement of the spring holding portion 52 while the ends 120 are lowed vertically into the moth of the grooves 102 of the spring clips 100 to secure the springs 110 within the grooves 102.

As depicted in FIG. 1, the furniture jig 20 can further comprise a controller 114 for operating the positioning assembly 54 to stretch and attach the springs 110. In certain aspects, the controller 114 can comprise a switch 116 for initiating and completing a cycle of operation of the furniture jig 20. As depicted, the switch 116 comprises a foot pedal, but can comprise a hand operated lever, button or other conventional means of imitating operation of the controller 114.

Figure 19:
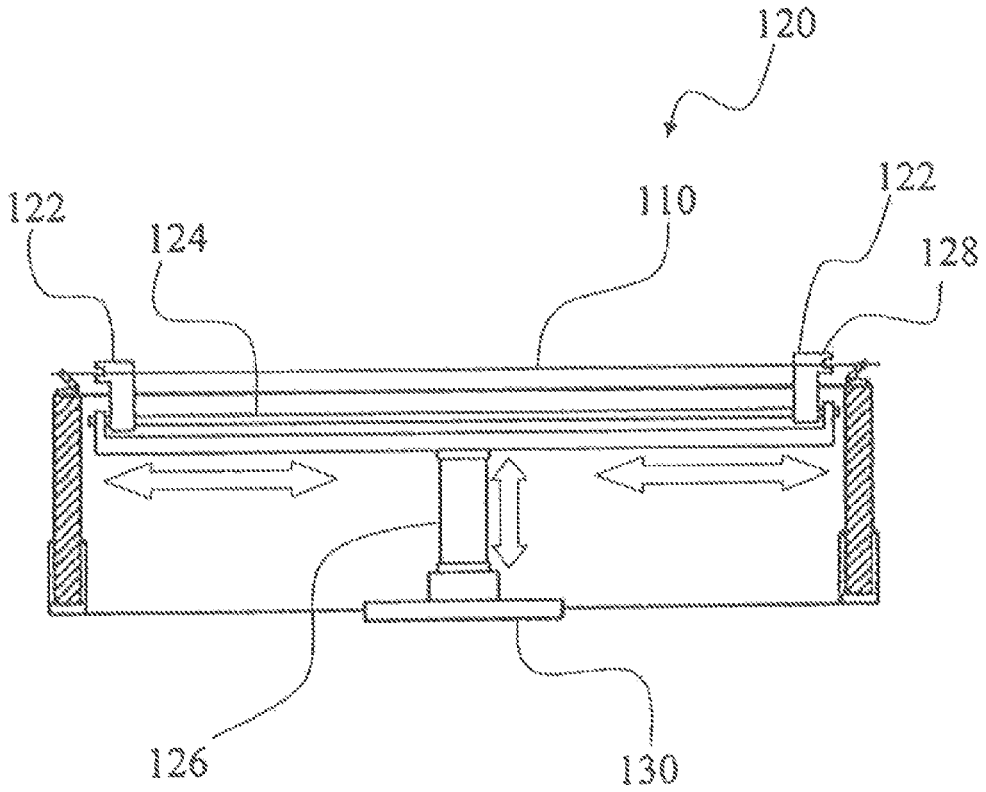
FIG. 19 is a schematic side view of a furniture assembly jig according to an embodiment of the present invention.
Figure 20:
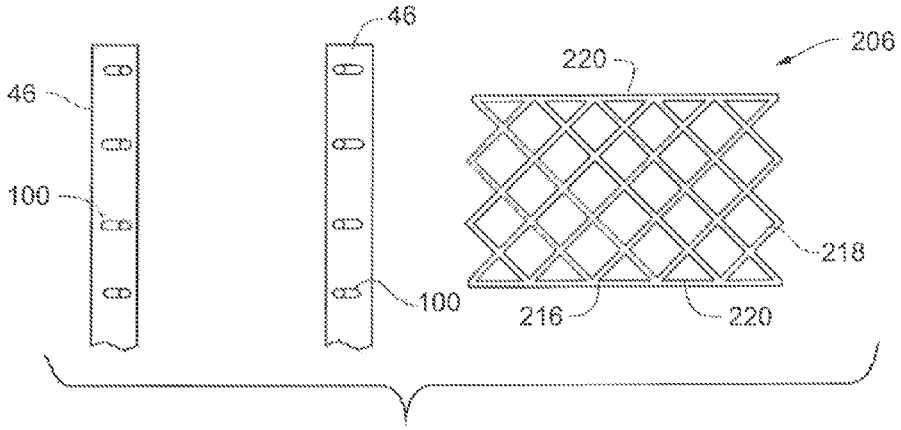
FIG. 20 is a representative top view of a seat box illustrating positioning of a webbing section on the seat box.
Figure 21:
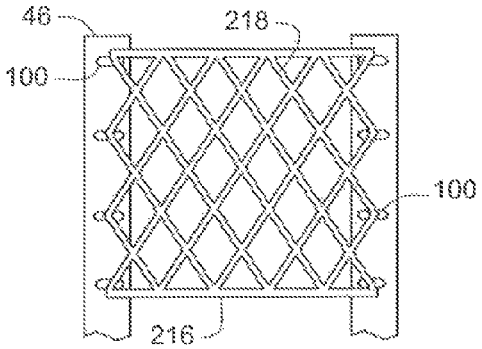
FIG. 21 is a representative top view of a seat box illustrating positioning of a webbing section on opposing walls of the seat box.
Figure 22:
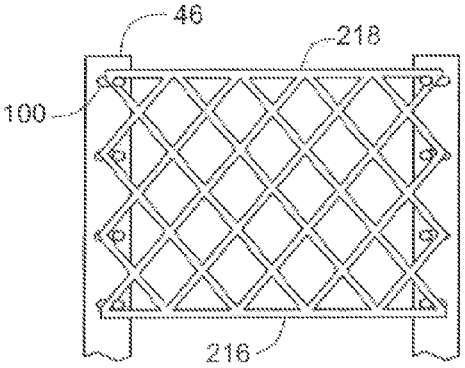
FIG. 22 is a representative top view of a seat box illustrating expanding the opposing walls to tension the webbing section.
Figure 23:
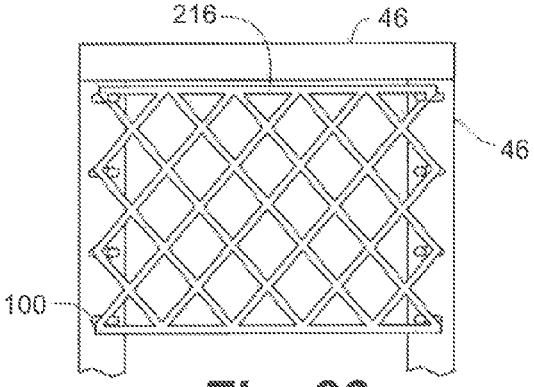
FIG. 23 is a representative top view of a seat box illustrating affixing of an end wall to the opposing walls to maintain the tension on the webbing section.
Figure 24:
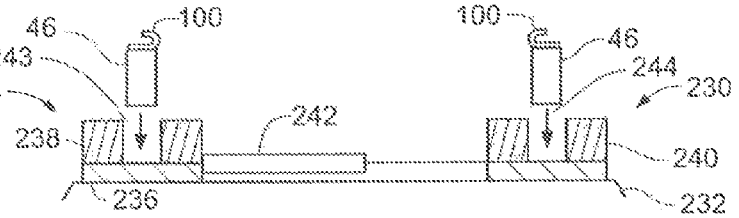
FIG. 24 is a representative side view of a furniture jig illustrating insertion of opposing walls into vises of the furniture jig according to an embodiment of the present invention.
Figure 25:
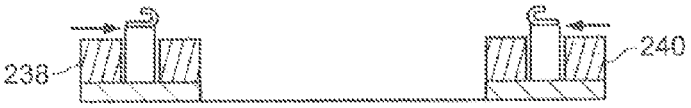
FIG. 25 is a representative side view of the furniture jig of FIG. 24 illustrating closing of the vises to retain the opposing walls.
Figure 26:
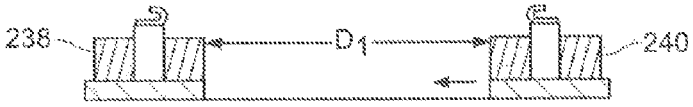
FIG. 26 is a representative side view of the furniture jig of FIG. 24 illustrating positioning the vises such that the opposing walls are a first distance apart.
Figure 27:
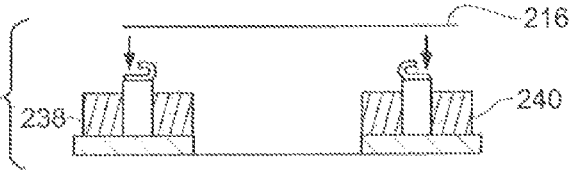
FIG. 27 is a representative side view of the furniture jig of FIG. 24 illustrating positioning the webbing section onto the opposing walls.
Figure 28:
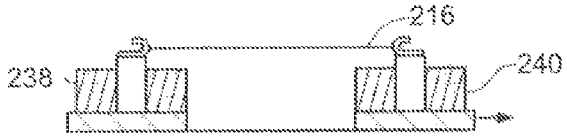
FIG. 28 is a representative side view of the furniture jig of FIG. 24 illustrating positioning the vises to pull the opposing walls apart and tensioning the webbing section.
Figure 29:
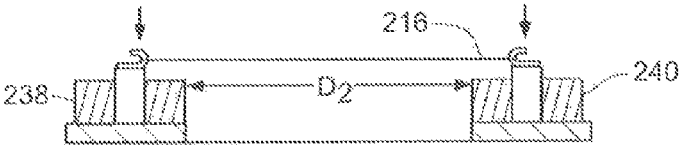
FIG. 29 is a representative side view of the furniture jig of FIG. 24 illustrating securing the webbing section to the opposing wall while tensioned by the furniture jig.
Figure 30:
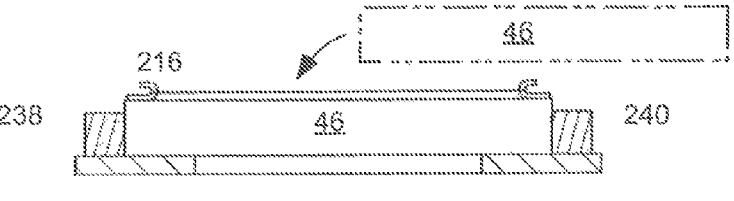
FIG. 30 is a representative side view of the furniture jig of FIG. 24 illustrating affixing an end wall to the opposing walls to maintain the tension on the webbing section.
Figure 31:
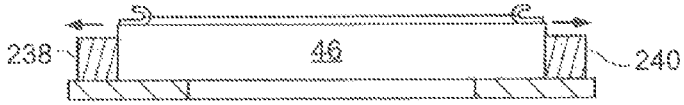
FIG. 31 is a representative side view of the furniture jig of FIG. 24 illustrating opening the vises to release the webbing section.
Figure 32:
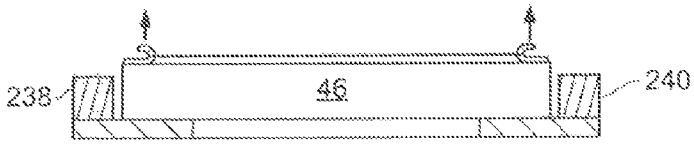
FIG. 32 is a representative side view of the furniture jig of FIG. 24 illustrating removing an assembled seat box from the furniture jig.
Figure 33:
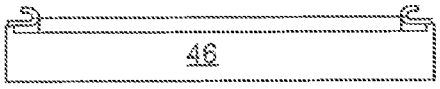
FIG. 33 is a representative side view of the furniture jig of FIG. 24 assembled by the furniture jig according to an embodiment of the present invention.
Figure 34:
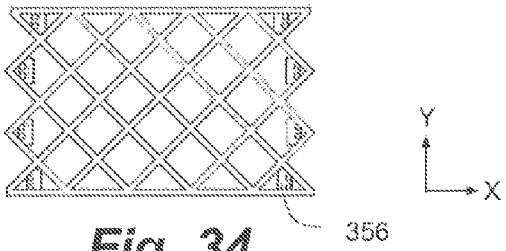
FIG. 34 is a representative plan view of spring webbing, such as an elastomeric webbing, loaded on a series of arms each with two hook prongs.
Figure 35:
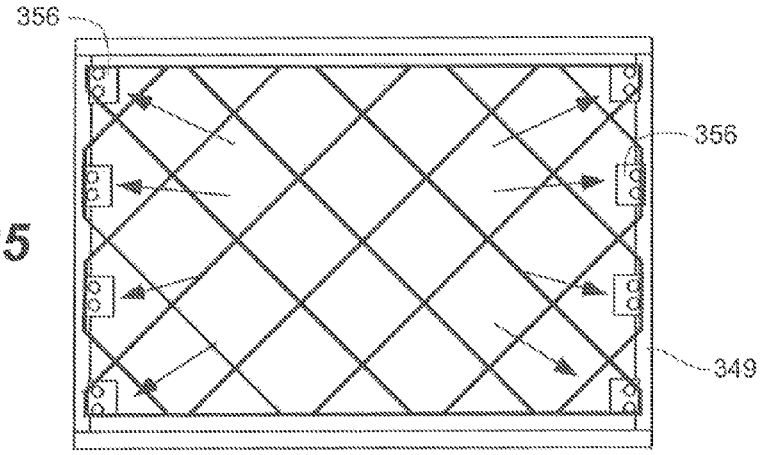
FIG. 35 is a representative plan view of the webbing and arms of FIG. 34 expanded into a hooking engagement with hooks on a furniture frame.
Figure 36:
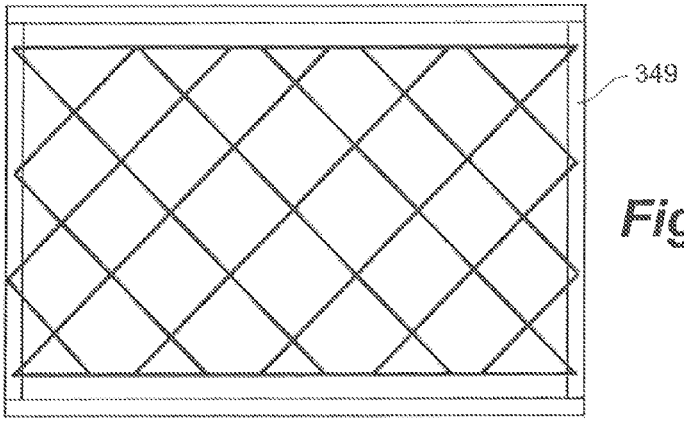
FIG. 36 is a representative plan view the webbing of FIG. 35 with the arms retracted away.

As depicted in FIG. 19, a furniture jig 120, according to an embodiment of the present invention, comprises at least two spring positioning elements 122, at least one horizontal positioning element 124 and an elevation assembly 126. Each positioning assembly 122 further comprises a spring receiving portion 128 for engaging a portion of the spring 110 proximate to the ends 112 of the springs. In one aspect, the horizontal positioning element 124 comprises a horizontal track wherein each positioning assembly 122 can be slidably engaged to the track such that the positioning assemblies 122 are movable along the track 124 in a horizontal axis. In other embodiments, the horizontal positioning element 124 can comprise a hydraulic assembly, a worm gear or other means of moving the positioning elements 122 along the horizontal axis. The horizontal positioning assembly 122 is positioned on the elevation assembly 126, wherein the elevation assembly 126 is adapted to raise the horizontal positioning assembly 122 vertically to change the height of the horizontal axis defined by the horizontal positioning assembly 122 and align the horizontal positioning assembly 122 with the frame members. In certain embodiments, the elevation assembly 126 can comprise a hydraulic arm, worm gear or other conventional means of changing the height of the horizontal positioning assembly 122. In certain embodiments, the elevation assembly 126 can be positioned on a rotatable mount 130 allowing rotation of the horizontal positioning assembly 122 to align the spring positioning elements 122 with the connectors on the furniture frame components.

As shown in FIGS. 20-33, the ends of the springs or webbing section 216 are engaged to the spring clips 100 of the opposing frame components 46 such that the spring or webbing section 216 is suspended between the frame components 46. The opposing frame components 46 are initially positioned such that the springs or strands 218 are not tensioned when the springs webbing section 216 is suspended between the frame components 46. Once the webbing section 216 is suspended, the opposing frame components 46 are pulled apart to tension the springs or webbing section 216 such that the springs or webbing section 216 defines a receiving surface on which at least one cushion can be positioned. The end frame components 46 can then be affixed to the opposing frame components 46 to maintain the separation between the opposing frame components 46. In one aspect, the seat box can comprise at least one seat stretcher 221 extending between the opposing frame components 46 to prevent bowing of the opposing frame components 46 as a result of the tensioned webbing 206.

As shown in FIGS. 24-33, a furniture assembly jig 230 is illustrated. The jig 230 generally comprises a jig frame 232 and a stretcher assembly 234. In embodiments, the jig frame 232 defines an elongated track 236 on which the stretcher assembly 234 is positioned. The stretcher assembly 234 comprises a first frame vise 238, a second frame vise 240 and a positioning assembly 242. The first frame vise 238 defines a first slot 243 and can be moved along the track 236 by the positioning assembly 242. Similarly, the second frame vise 240 defines a second slot 244 and can be moved along the track 236 by the positioning assembly 242. The positioning assembly 242 can comprise a pneumatic cylinder 245 extending between the first and second frame vises 238, 240. The pneumatic cylinder 245 can be extended and retracted to move the first and second frame vises 238, 240. In one aspect, the jig frame 232 can be placed on a rotation mechanism allowing the entire jig 230 to be rotated allowing a worker on one side of a bench to rotate the jig frame 232 to be able to readily access the furniture components therein. The rotation mechanism may be a conventional industrial style turntable bolted or screwed or otherwise attached to both the bench and jig frame 232.

As shown in FIGS. 6-15, details of the operation of the jig 230 are presented. An opposing frame component 46 is positioned into the first and second slots 243, 244 before the first and second vises 238, 240 are closed to fix the opposing frame components 46 within the first and second vises 238, 240. The pneumatic cylinder 44 is then operated to position the first and second vises 238, 240 at a first distance d1 apart. Each webbing section 216 can then be engaged to the opposing frame components 46 held within the vises 238, 240. In one aspect, the vises 238, 240 are sufficiently close together when separated by distance d1 that the webbing section 216 can be positioned on the opposing frame components 46 without tensioning the webbing section 216. The pneumatic cylinder 245 can then be operated to push the vises 238, 240 apart until the vises 38, 40 are separated by a second distance d2 and tensioning the webbing section 216. The end walls 12 can then be affixed to the opposing walls 14 to maintain tension on the webbing section 216. The vises 238, 240 can then be opened and the assembled seat box can be removed.

Figure 37:
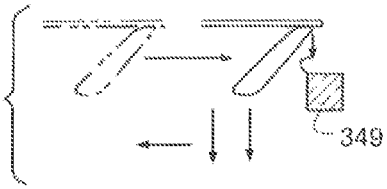

FIGS. 20-33 depict a method of assembling the furniture item comprising providing the jig 230 having the first vise 238, the second vise 240 and the positioning assembly 242. The method further comprises inserting at least one opposing frame component 46 into each vise 238, 240, wherein each opposing frame component 46 comprises a plurality of spring clips 100. The method also comprises operating the positioning assembly 242 to position the vises 38, 40 at a first distance d1 apart. The method then further comprises engaging the webbing section 216 to spring clips 100 of the opposing frame components 46 such that the webbing section 216 is suspended between the opposing frame components 46. The method also comprises tensioning the webbing section 216 by actuating the positioning assembly 242 to move the vises 238, 240 apart until separated by a second distance d2. Finally, the method comprises affixing the end frame components 46 to the opposing frame components 46 to maintain the tensioning of the webbing section 216. FIGS. 34-37 illustrate the operation of attach elastomeric webbing 348 to hooks extending from the frame furniture members 349. The arms 356 start in a retracted position and then expand outward in the x and y directions. The arms then may be lowered as illustrated in FIG. 37 so that the pieces of webbing each being held by two prongs can be lowered, such as by automatic means, so the pieces of webbing in between each of the two prongs may be released and hooked in a hooked position and the arms may be moved out of the way, see FIG. 37. Such movements may be by tracks, pivots, or other mechanisms.

While the invention is amenable to various modifications and alternative forms, specifics thereof have been shown by way of example in the drawings and described in detail. It is understood, however, that the intention is not to limit the invention to the particular embodiments described. On the contrary, the intention is to cover all modifications, equivalents, and alternatives falling within the spirit and scope of the invention as defined by the appended claims.

The invention claimed is:

1. A furniture assembly jig for assembling a furniture item, comprising:

a jig frame comprising a furniture frame positioning portion comprising a plurality of constraint members defining a plurality of receiving regions for receiving a plurality of furniture frame components arranged in a rectangular shape for fastening together into a furniture frame;

a spring stretcher portion comprising a plurality of spring holding portions arranged in opposing pairs, each spring holding portion configured for releasably receiving an end portion of a spring, wherein the spring holding portions are attached to support members and the support members with the spring holding portions are movably attached to the jig frame and are movable between a first spring loading position and a second position by drive portions;

wherein the spring holding portions are a first distance apart at the first position and the spring holding portions are a second distance apart at the second position, the second distance being greater than the first distance; and an elevating assembly for moving one of the spring stretcher portion and the furniture frame positioning portion upwardly and downwardly relative to the other of the spring stretcher portion and the furniture frame positioning portion.

2. The furniture assembly jig of claim 1, wherein the receiving regions comprise an elongated slot for receiving and maintaining at least two of the plurality of furniture frame components in an upright position.

3. A furniture assembly jig for assembling a furniture item, comprising:

a jig frame comprising a furniture frame positioning portion comprising a plurality of constraint members defining a plurality of receiving regions for receiving a plurality of furniture frame components arranged in a rectangular shape for fastening together into a furniture frame;

a spring stretcher portion comprising a plurality of spring holding portions arranged in opposing pairs, each spring holding portion configured for releasably receiving an end portion of a spring, wherein the spring holding portions are attached to support members and the support members with the spring holding portions are movably attached to the jig frame and are movable between a first spring loading position and a second position by drive portions;

wherein the spring holding portions are a first distance apart at the first position and the spring holding portions are a second distance apart at the second position, the second distance being greater than the first distance;

a rotatable mount attached to the jig frame for rotating at least the furniture frame positioning portion; and an elevating assembly for lifting the furniture frame components positioned one of within and adjacent the plurality of receiving regions to engage the end portions of the spring.

4. The furniture assembly jig of claim 3, wherein the elevating assembly comprises at least one extendable piston for elevating the jig frame.

5. The furniture assembly jig of claim 3, wherein each furniture frame component comprises at least one engagement feature, wherein each engagement feature further comprises a vertically oriented hook portion engagable to the end portion of the spring.

6. The furniture assembly jig of claim 5, wherein the end portion of each spring defines a horizontally oriented hook portion engagable by the hook portion of the engagement feature.

7. The furniture assembly jig of claim 1, wherein spring is one of: a coil spring, magazine spring, sinuous S spring and web spring.

8. A furniture assembly jig for assembling a furniture item, comprising:

a jig frame comprising a furniture frame positioning portion comprising a plurality of constraint members defining a plurality of receiving regions for receiving a plurality of furniture frame components arranged in a rectangular shape for fastening together into a furniture frame;

a spring stretcher portion comprising a plurality of spring holding portions arranged in opposing pairs, each spring holding portion configured for releasably receiving an end portion of a spring, wherein the spring holding portions are attached to support members and the support members with the spring holding portions are movably attached to the jig frame and are movable between a first spring loading position and a second position by drive portions;

wherein the spring holding portions are a first distance apart at the first position and the spring holding portions are a second distance apart at the second position, the second distance being greater than the first distance;

a rotatable mount attached to the jig frame for rotating at least the furniture frame positioning portion; and wherein the spring stretcher portion comprises at least one extendable piston to move the spring holding portions with respect to each other and with respect to the furniture frame components.

9. A furniture assembly jig for assembling a furniture item, comprising:

a jig frame comprising a furniture frame positioning portion comprising a plurality of constraint members defining a plurality of receiving regions for receiving a plurality of furniture frame components arranged in a rectangular shape for fastening together into a furniture frame;

a spring stretcher portion comprising a plurality of spring holding portions arranged in opposing pairs, each spring holding portion configured for releasably receiving an end portion of a spring, wherein the spring holding portions are attached to support members and the support members with the spring holding portions are movably attached to the jig frame and are movable between a first spring loading position and a second position by drive portions;

wherein the spring holding portions are a first distance apart at the first position and the spring holding portions are a second distance apart at the second position, the second distance being greater than the first distance;

a rotatable mount attached to the jig frame for rotating at least the furniture frame positioning portion; and wherein the support members comprise arms and each furniture frame component comprises at least one engagement feature, further wherein each arm is curved to position the end portion of the spring within the corresponding engagement feature without the engagement feature contacting the furniture frame component.

10. The furniture assembly jig of claim 1, further comprising a positioning assembly within the jig frame, wherein the support members comprise arms, and wherein the positioning assembly is adapted to return the arms to the first position once the spring is engaged to the furniture frame components.

11. A furniture assembly jig for assembling a furniture item, comprising:

a jig frame comprising a furniture frame positioning portion and a spring stretcher portion, the furniture frame positioning portion having a plurality of receiving regions for receiving a plurality of furniture frame components arranged in a rectangular shape for fastening together into a furniture frame;

the spring stretcher portion comprising a plurality of spring holding portions arranged in opposing pairs, each spring holding portion configured for releasably receiving an end portion of a spring, wherein the spring holding portions are attached to powered movable support members whereby the spring holding portions and are movable with respect to furniture frame components in the receiving regions providing spring loading positions for attaching at least one spring to the spring holding portions and for extending the at least one spring;

an elevating assembly for moving one of the spring stretcher portion and the furniture frame positioning portion upwardly and downwardly relative to the other of the spring stretcher portion and the furniture frame positioning portion.

12. The furniture assembly jig of claim 11 for assembling a furniture item wherein at least one of the spring holding portions and furniture frame components are movable for positioning ends of the at least one spring at or in proximity to fastening locations on the furniture frame components.

13. The furniture assembly jig of claim 11 for assembling a furniture item wherein the furniture frame components in the receiving regions are movable for positioning the furniture frame components in proximity to ends of the at least one spring for attachment of the at least one spring to the furniture frame components.

14. The furniture assembly jig of claim 11 wherein the furniture frame positioning portion is rotatable with respect to a floor surface.

15. The furniture assembly jig of claim 11 wherein, spring holding portions are a first distance apart at a first position and the spring holding portions are a second distance apart at a second position, the second distance being greater than the first distance;

a rotatable mount attached to the jig frame for rotating at least the furniture frame positioning portion.

* * * * *